US007508136B2

(12) United States Patent
Kwon et al.

(10) Patent No.: US 7,508,136 B2
(45) Date of Patent: Mar. 24, 2009

(54) PLASMA DISPLAY PANEL

(75) Inventors: Jae-Ik Kwon, Suwon-si (KR); Kyoung-Doo Kang, Suwon-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 320 days.

(21) Appl. No.: 11/127,369

(22) Filed: May 11, 2005

(65) Prior Publication Data

US 2005/0253516 A1 Nov. 17, 2005

(30) Foreign Application Priority Data

May 12, 2004 (KR) ..... 10-2004-0033392

(51) Int. Cl.
*H01J 17/49* (2006.01)
*G09G 3/38* (2006.01)

(52) U.S. Cl. ..... 313/582; 313/583; 313/584; 313/585

(58) Field of Classification Search ..... 313/582–587, 313/589; 445/23–25; 315/169.4; 345/60
See application file for complete search history.

(56) References Cited

U.S. PATENT DOCUMENTS

| | | | | |
|---|---|---|---|---|
| 5,640,068 | A | 6/1997 | Amemiya | |
| 5,952,782 | A * | 9/1999 | Nanto et al. | 313/584 |
| 6,249,264 | B1 * | 6/2001 | Sano et al. | 345/60 |
| 6,295,040 | B1 * | 9/2001 | Nhan et al. | 345/60 |
| 6,479,935 | B1 * | 11/2002 | Park et al. | 313/586 |
| 6,956,546 | B1 * | 10/2005 | Hashimoto et al. | 345/60 |
| 2003/0098825 | A1 * | 5/2003 | Kim et al. | 345/63 |
| 2003/0168979 | A1 * | 9/2003 | Ahn et al. | 313/587 |
| 2004/0113555 | A1 * | 6/2004 | Han et al. | 313/586 |

FOREIGN PATENT DOCUMENTS

JP 2003-92064 3/2003

(Continued)

OTHER PUBLICATIONS

Patent Abstracts of Japan, Publication No. 2004-071220; Date of Publication: Mar. 4, 2004; in the name of Shigeru Kojima.

(Continued)

*Primary Examiner*—Joseph L Williams
*Assistant Examiner*—Elmito Breval
(74) *Attorney, Agent, or Firm*—Christie, Parker & Hale, LLP

(57) ABSTRACT

A plasma display panel to prevent misdischarge in a non-discharge region. The plasma display panel includes a first substrate and a second substrate facing the first substrate. A plurality of display electrodes are formed extending on the first substrate, and a plurality of address electrodes are formed extending on the second substrate and cross the display electrodes. Barrier ribs including a plurality of barrier rib members are positioned between the first substrate and the second substrate, and form a plurality of discharge cells and non-discharge regions. A phosphor is formed inside each of the discharge cells. Each of the non-discharge regions includes one of exposure regions where a part of one of the display electrodes is exposed. The exposure regions are placed alternately in an extending direction of the display electrodes.

20 Claims, 5 Drawing Sheets

FOREIGN PATENT DOCUMENTS

| | | |
|---|---|---|
| JP | 2003-303550 | 10/2003 |
| JP | 2003-303551 | 10/2003 |
| JP | 2003-331741 | 11/2003 |
| JP | 2004-71220 | 3/2004 |
| JP | 2004-79314 | 3/2004 |

OTHER PUBLICATIONS

Patent Abstracts of Japan, Publication No. 2003-092064, dated Mar. 28, 2003, in the name of Kimio Amamiya.

Patent Abstracts of Japan, Publication No. 2003-303550, dated Oct. 24, 2003, in the name of Shigeisa Kan.

Patent Abstracts of Japan, Publication No. 2003-303551, dated Oct. 24, 2003, in the name of Shigeisa Kan.

Patent Abstracts of Japan, Publication No. 2003-331741, dated Nov. 21, 2003, in the name of Jung Hun Kim et al.

Patent Abstracts of Japan, Publication No. 2004-079314, dated Mar. 11, 2004, in the name of Kan Shigeisa et al.

* cited by examiner

PLASMA DISPLAY PANEL

CROSS REFERENCE TO RELATED APPLICATION

This application claims priority to and the benefit of Korean Patent Application No. 10-2004-0033392, filed on May 12, 2004 in the Korean Intellectual Property Office, the entire content of which is incorporated herein by reference.

BACKGROUND OF THE INVENTION

1. Field of the Invention

The present invention relates to a plasma display panel (PDP) and, in particular, to display electrodes of the PDP.

2. Description of the Related Art

A plasma display panel (PDP) is generally a display device in which vacuum ultraviolet (VUV) rays from plasma generated by gas discharge excite phosphors to emit red, green, blue visible lights for producing an image. Such a PDP can achieve a large screen display with a size over 60 inches (~152.4 cm) while keeping its thickness within 10 cm. As an emissive display device like a cathode ray tube, the PDP has features of excellent color reproduction and no distortion along viewing angle. Compared to a liquid crystal display (LCD) device, the PDP has an advantage of a simple manufacturing process resulting in a good productivity and low cost. As a result, the PDP has emerged as a promising flat display device for home and industry.

In a typical alternating current (AC) PDP, as shown in FIG. 5, address electrodes 103 are formed on a rear substrate 101 and extend in a first direction (y-direction) and spaced apart along a second direction (x-direction). A dielectric layer 105 is formed on the rear substrate 101 to cover the address electrodes 103. On top of the dielectric layer 105, barrier ribs 107 positioned between the address electrodes 103 are formed in a stripe pattern, and red (R), green (G) and blue (B) phosphor layers 109R, 109G, 109B are formed between the barrier ribs 107.

On a first surface of a front substrate 111 facing the rear substrate 101, formed along one direction crossing the address electrode are X and Y electrodes 113, 115, i.e., display electrodes, each including one of a pair of transparent electrodes 113*a*, 115*a* and one of a pair of bus electrodes 113*b*, 115*b*. A dielectric layer 117 and a MgO protective layer 119 in turn are formed on the entire front substrate 111 covering the X and Y electrodes 113, 115.

Discharge cells 121R, 121G, 121B are formed at locations where the address electrodes 103 of the rear substrate 101 cross a pair of the X and Y electrodes 113, 115 of the front substrate 111.

Such an AC PDP has millions of discharge cells arranged in a matrix pattern and adopts a driving method using memory characteristics to drive such a large number of discharge cells simultaneously.

As for the driving method, a voltage difference over a certain value is necessary to start a discharge between the X electrode 113 (a sustain electrode) and the Y electrode 115 (a scan electrode), both composing a pair of the display electrodes. A threshold voltage having the certain value is called a firing voltage (Vf). When an address voltage (Va) is applied between the Y electrode 115 and the address electrode 103, the discharge starts. The plasma is generated by the discharge in the discharge cell, and the electrons and ions in the plasma move toward the electrodes having the opposite polarity. As a result, the electrical current flows.

Since the dielectric layer 105 or 117 is coated on each electrode 103, 113, 115 of the AC PDP, most of the moving space charge is deposited on the dielectric layer 105 or 117 with the opposite polarity. Therefore, the net voltage difference across the gap between the Y electrode 115 and the address electrode 103 becomes smaller than the initial address voltage (Va), and that causes the discharge to be weak and disappear eventually. At this time, the dielectric layer 117 on the Y electrode collects a relatively large amount of the ions, compared to the dielectric layer 117 on the X electrode 113. The accumulated charges on the dielectric layer 117 over the X and Y electrodes 113, 115 are called the wall charge (Qw). Also, the voltage across the space between the X and Y electrodes 113, 115 is called the wall voltage (Vw).

For the case where a certain voltage (Vs; discharge sustain voltage) is applied between the X electrode 113 and the Y electrode 115 successively, the discharge starts in the discharge cell 121R, 121G, 121B when the sum (Vs+Vw) of the discharge sustain voltage (Vs) and the wall voltage (Vw) exceeds the firing voltage (Vf). The vacuum ultraviolet ray generated at this moment excites the corresponding phosphor layer 109R, 109G, 109B so that visible lights are emitted, and the transparent front substrate 111 transmits the visible light to show an image.

In the PDP with the barrier ribs 107 and the display electrodes 113, 115 formed in a stripe pattern as shown in FIG. 5, however, crosstalk may occur between one discharge cell and the neighboring cells 121R, 121G, 121B. Also, since the discharge space is open in the direction of the barrier rib, misdischarge may occur between the neighboring discharge cells 121R, 121G, 121B in the direction of the barrier rib. In order to prevent the misdischarge, the distance from the display electrode 113, 115 to that of the neighboring cells 121R, 121G, 121B in the direction (y-direction) of the barrier rib 107 is larger than a certain value. However, that hinders improving a luminous efficiency.

The U.S. Pat. No. 5,640,068 discloses a plasma display panel for solving the aforementioned problem. In addition to barrier ribs formed in a stripe pattern, its structure includes a pair of transparent electrodes of display electrodes formed, in each discharge cell, protruding from each bus electrode and facing each other. Even this structure may not prevent the misdischarge from happening in the direction along the barrier ribs.

A PDP with barrier ribs, formed in a matrix pattern by horizontal and vertical barrier ribs is provided to solve the problem as well as to enhance the luminous efficiency by increasing the phosphor area in each discharge cell. Further, in a PDP with partially modified barrier ribs in the structure, misdischarge in a non-discharge area may occur because bus electrodes of the display electrodes placed in the neighboring discharge cells are exposed to the non-discharge area. Thus, the misdischarge in the non-discharge area may cause the degradation in color purity due to a neon (Ne) light-discharge and in PDP efficiency due to unwanted power consumption.

SUMMARY OF THE INVENTION

A feature in exemplary embodiments of the present invention is to provide a plasma display panel that can prevent misdischarge in a non-discharge region.

In an exemplary embodiment according to the present invention, a plasma display panel includes a first substrate, a second substrate facing the first substrate, a plurality of display electrodes formed extending on the first substrate, and a plurality of address electrodes formed extending on the second substrate and crossing the display electrodes. The plasma display panel also includes barrier ribs including a plurality of barrier rib members. The barrier ribs are positioned between the first substrate and the second substrate, and form a plurality of discharge cells and non-discharge regions. A phosphor is formed inside each of the discharge cells. Each of the non-discharge regions includes one of exposure regions where a part of one of the display electrodes is exposed, the exposure regions being placed alternately in an extending direction of the display electrodes.

Each of the exposure regions may be formed at one side of one of the barrier rib members that extend in the extending direction of the display electrodes.

The exposure regions may be formed alternately at one side of one of the barrier rib members that extend in the extending direction of the display electrodes and at an opposing side of an adjacent one of the barrier rib members that extend in the extending direction of the display electrodes.

The exposure regions may be formed adjacent to the barrier rib members that are at two diagonal positions of each of the discharge cells.

The exposure regions may be formed at alternating locations in a zigzag pattern in the extending direction of the display electrodes.

The exposure regions may be formed alternately between an X electrode of one discharge cell and a Y electrode of an adjacent discharge cell among the plurality of discharge cells, the X electrode and the Y electrode composing the display electrodes.

Each of the plurality of the display electrodes may consist of a bus electrode and a transparent electrode, and a part of the bus electrode of each of the display electrodes may be exposed to at least one of the exposure regions.

A part of the bus electrode corresponding to one of the discharge cells may be exposed to a corresponding one of the exposure regions and another bus electrode corresponding to an adjacent one of the discharge cells may be blocked by one of the barrier rib members that extends in an extending direction of the bus electrode.

The barrier rib members may include first barrier rib members formed in the extending direction of the address electrodes and placed parallel to each other, second barrier rib members formed in a direction crossing the first barrier rib members and placed parallel to each other, and third barrier rib members connecting the first and second barrier rib members with an incline at two diagonal corners of each of the discharge cells.

The second barrier ribs may be interconnected by fourth barrier rib members, each of which is positioned between the second barrier rib member of one of the discharge cells and the adjacent second barrier rib member of an adjacent one of the discharge cells.

Each of the discharge cells may be formed asymmetrically about an extending direction of the address electrodes and/or the extending direction of the display electrodes.

Both sides of each of the discharge cells in an extending direction of the address electrodes may be formed narrower than a center of the discharge cell.

In both sides of each of the discharge cells in an extending direction of the address electrodes, one corner may be formed with a right angle and the other corner may be formed inclined so that a discharging region becomes narrower as it moves from a center of the discharge cell to the sides.

In another exemplary embodiment according to the present invention, a plasma display panel includes a first substrate, a second substrate facing the first substrate, and a plurality of display electrodes formed extending in a first direction on the first substrate. The plasma display panel also includes a plurality of address electrodes formed on the second substrate, and extending in a second direction, which is substantially perpendicular to the first direction. Barrier ribs are positioned between the first and second substrates, and form a plurality of discharge cells and non-discharge regions. A phosphor is formed inside each of the discharge cells. Each of the display electrodes is exposed to every other one of the non-discharge regions in the first direction.

DETAILED DESCRIPTION

Figure 1:
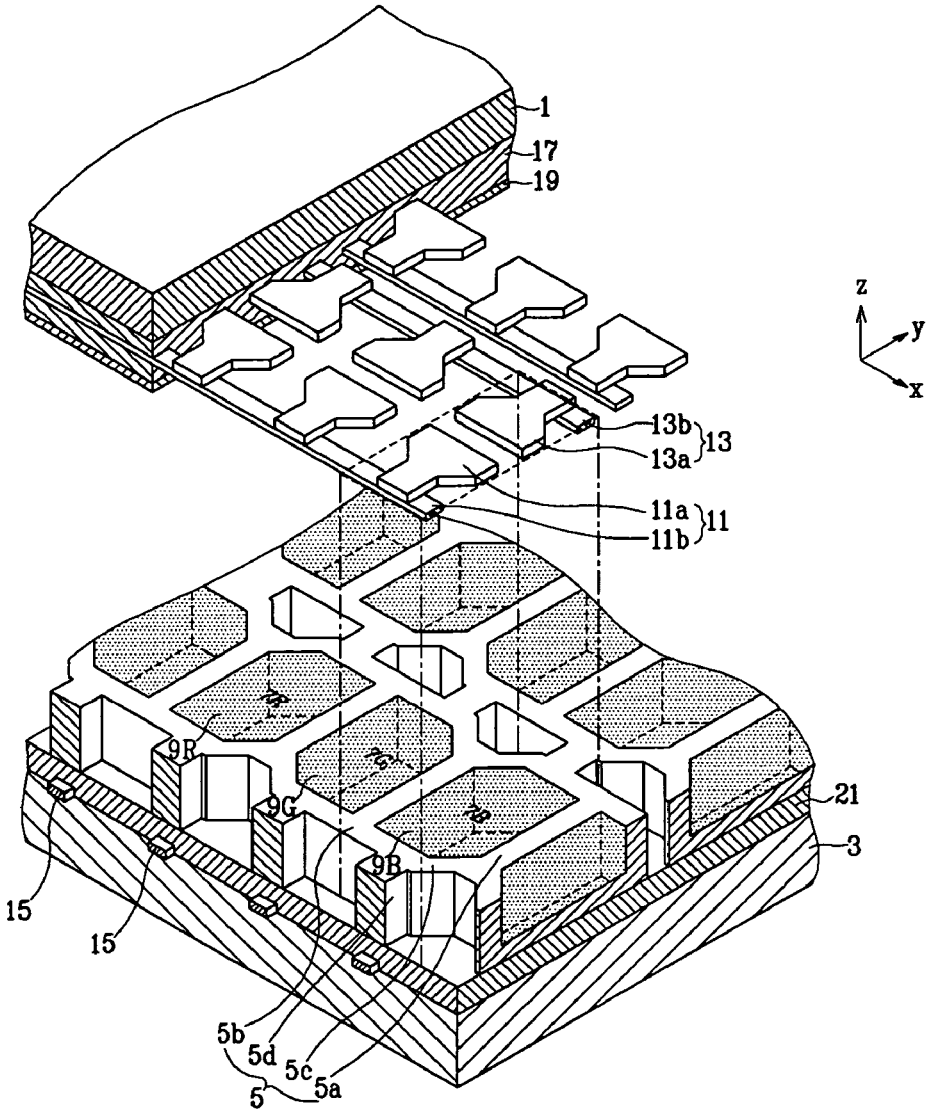
FIG. 1 is a partial perspective view of a disassembled plasma display panel according to an exemplary embodiment of the present invention.
Figure 2:
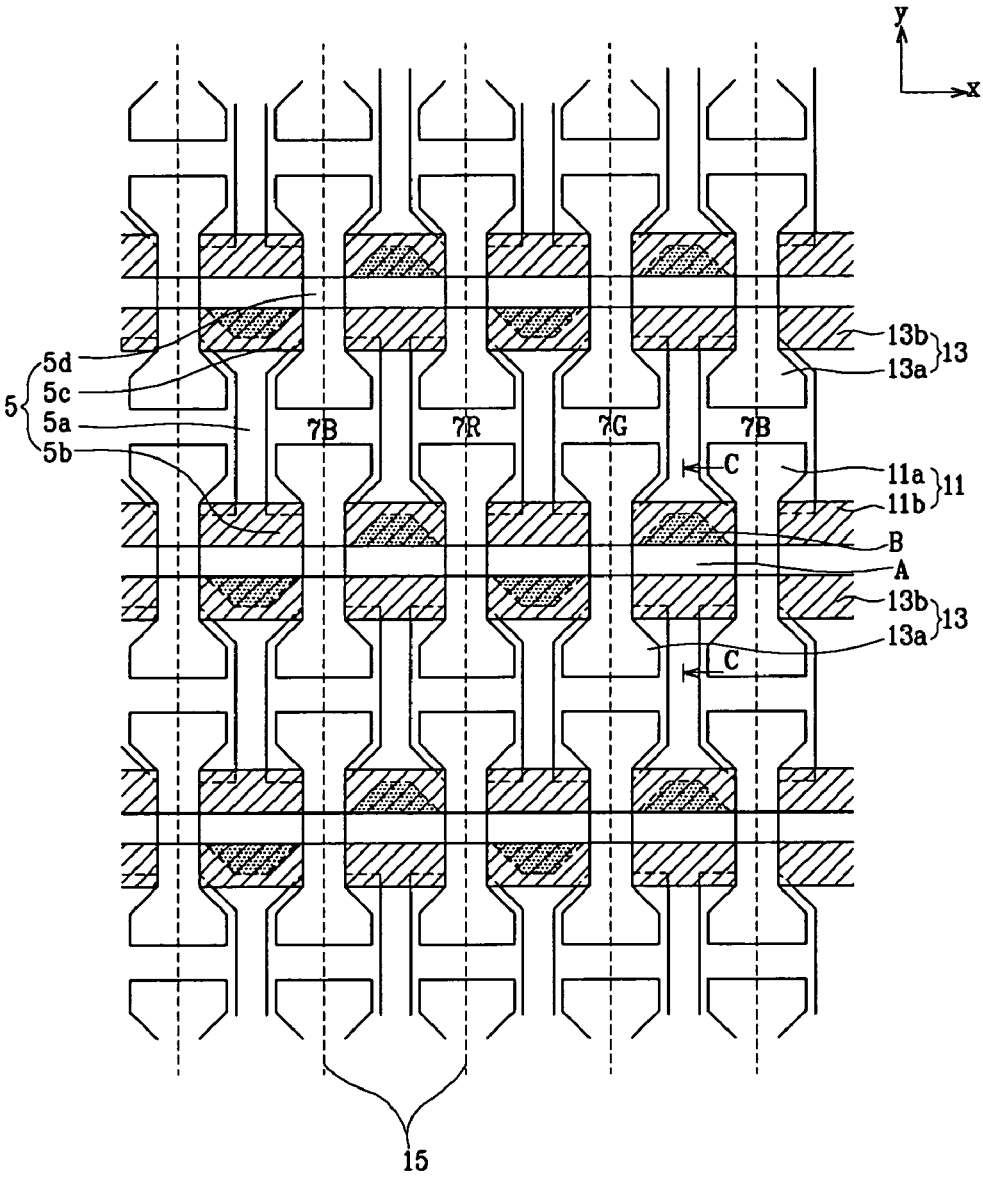
FIG. 2 is a plan view of the plasma display panel of FIG. 1.
Figure 3:
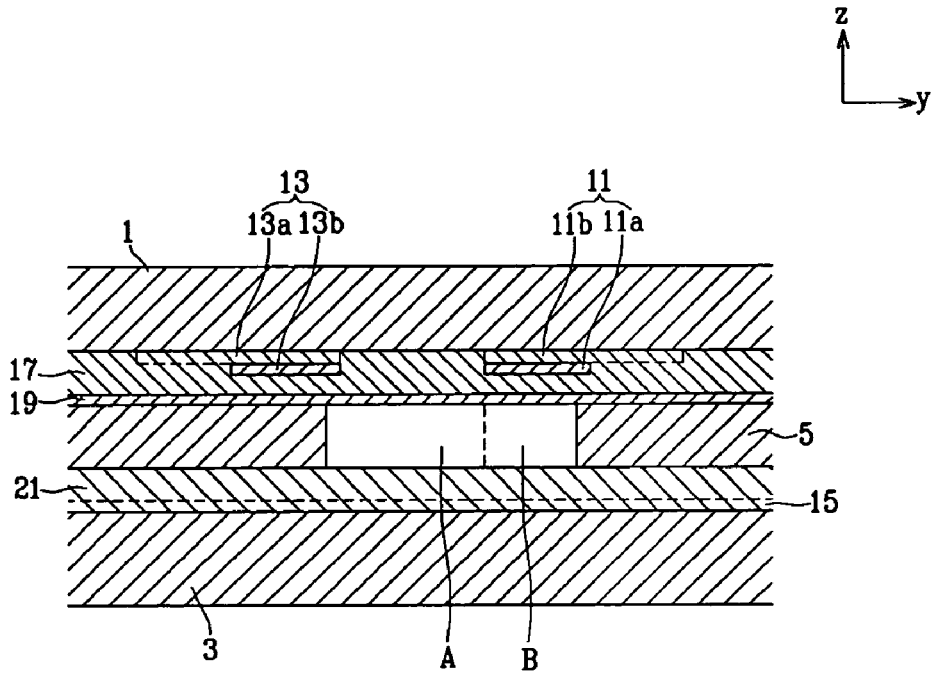
FIG. 3 is a partial sectional view taken along the section line C-C of FIG. 2.

As shown in FIGS. 1-3, a plasma display panel (PDP) includes a first substrate 1 (front substrate), and a second substrate 3 (rear substrate) facing the first substrate 1. The first and second substrates 1 and 3 are hermetically joined to each other at their respective edges. A plurality of discharge cells 7R, 7G, 7B for plasma discharge are formed by a plurality of barrier ribs 5 positioned between the front substrate 1 and the rear substrate 3. Red (R), green (G) and blue (G) phosphors 9R, 9G, 9B are respectively formed on the inside of the discharge cells 7R, 7G, 7B.

Corresponding to the discharge cells 7R, 7G, 7B, display electrodes 11, 13 are formed on the first substrate 1, extending in the x-direction and placed parallel to each other with a pitch of the discharge cells 7R, 7G, 7B in the y-direction. Address electrodes 15 are formed on the second substrate 3, extending in the direction (y-direction) crossing the display electrodes 11, 13 and placed parallel to each other with a pitch of the discharge cells 7R, 7G, 7B in the x-direction.

The display electrodes 11, 13 include X electrodes 11 and Y electrodes 13 that are placed parallel to each other and correspond to each of the discharge cells 7R, 7G, 7B. The X electrodes 11 and Y electrodes 13 are formed on the first substrate 1 and covered by a dielectric layer 17 and a MgO protective layer 19, in turn.

The X and Y electrodes 11, 13 include a transparent electrode 11*a* or 13*a* and a bus electrode 11*b* or 13*b*, respectively. The X and Y electrodes 11 and 13 may alternatively include only the transparent electrodes 11*a*, 13*a* or the bus electrodes 11*b*, 13*b*, respectively. The transparent electrodes 11*a* and 13*a* serve to cause surface discharge inside the discharge cells 7R, 7G, 7B and are made of transparent indium-tin oxide (ITO) to obtain a high opening ratio and a high transmittance for visible light. The bus electrodes 11*b* and 13*b* should be made of a metallic material such as aluminum to obtain high conductance by compensating high resistance of the transparent electrodes 11*a*, 13*a*. A pair of bus electrodes 11*b*, 13*b* corresponding to each of the discharge cells 7R, 7G, 7B, extends in the x-direction and is placed parallel to each other with a gap in the y-direction. Like the bus electrodes 11*b*, 13*b*, the transparent electrodes 11*a*, 13*a* may be formed in a stripe pattern along the x-direction. However, the transparent electrodes 11*a*, 13*a* of the present embodiment may be formed protruding, respectively, from the bus electrodes 11*b*, 13*b* toward the center of each of the discharge cells 7R, 7G, 7B. Also, the bus electrodes 11*b*, 13*b* may be formed meanderingly to follow the shape of the barrier rib 5.

The address electrodes 15 are formed on the second substrate 3, extend in the direction (y-direction) crossing the X and Y electrodes 11, 13 and placed parallel to each other with a pitch in the x-direction. The address electrodes 15 are covered with a dielectric layer 21.

The barrier ribs 5 are formed between the front substrate 1 having the X and Y electrodes 11, 13 and the rear substrate 3 having the address electrodes 15, and define the independent discharge cells 7R, 7G, 7B for the plasma discharge.

A non-discharge region A is formed outside the barrier ribs 5 in the space between the neighboring discharge cells 7R, 7G, 7B in the extending direction (y-direction) of the address electrodes 15, and a discharge region is the inside of each of the discharge cells 7R, 7G, 7B. In other words, the barrier ribs 5 form the closed discharge cells 7R, 7G, 7B in the x-y coordinate plane between the front substrate 1 and the rear substrate 3. The discharge cells 7R, 7G, 7B are directly attached to each other in the x-direction and coupled to each other in the y-direction through the non-discharge regions A that separate the neighboring discharge cells in the y-direction. The non-discharge regions A are placed generally in the x-direction crossing the address electrodes 15.

The discharge cells 7R, 7G, 7B are filled with a discharge gas and provide the space where gas discharge occurs under an address or a sustain voltage applied therein. The non-discharge region A is a space or a region where discharge or light emission is not planned and where a voltage is not intentionally applied.

The non-discharge region A includes an exposure region B where the display electrode 11 or 13 is partially exposed. The exposure regions B are placed alternately in the extending direction (x-direction) of the display electrodes 11, 13.

In the present invention, therefore, the discharge cells 7R, 7G, 7B are asymmetrical about both the extending direction (x-direction) of the display electrodes 11, 13 and the extending direction (y-direction) of the address electrodes 15. Due to the asymmetrical discharge cells 7R, 7G, 7B and the bus electrodes 11*b*, 13*b* formed in a stripe pattern, a part of the bus electrodes 11*b*, 13*b* is exposed to the non-discharge region A at the position where the barrier rib does not coincide with the bus electrode 11*b*, 13*b*.

If both the bus electrodes 11*b*, 13*b* are exposed to one non-discharge region A, misdischarge may occur even in the non-discharge region A, and that may cause a serious degradation in color purity and luminous efficiency of the PDP. Therefore, to prevent the misdischarge in the non-discharge region A, the exposure regions B included in the non-discharge regions A are formed alternately along the extending direction (x-direction) of the display electrodes 11, 13.

The shape of the non-discharge regions A including the exposure regions B are defined by the arrangement of the barrier ribs 5. To begin with, the arrangement of the non-discharge regions A and the exposure regions B are explained in the x-y plane.

As aforementioned, the non-discharge regions A are arranged along the direction (x-direction) crossing the address electrode 15 and therefore, placed between the neighboring discharge cells 7R, 7G, 7B in the y-direction. Each exposure region B is formed inside a corresponding one of the non-discharge regions A in a manner where the exposure regions B are placed alternately along the x-direction.

As shown in FIG. 2, the locations of the exposure regions B are alternating between the sides of the X and Y electrodes 11, 13 that belong to each different display electrode 11, 13 of the neighboring discharge cells 7R, 7G, 7B, respectively. In other words, the exposure regions B are located only on the X electrode 11 side and not on the Y electrode side 13, or only on the Y electrode 13 side and not on the X electrode 11 side.

Therefore, a part of the X and Y electrodes 11, 13 including the transparent electrodes 11*a*, 13*a* and the bus electrodes 11*b*, 13*b* is exposed to the exposure regions B. Specifically, a local surface of the bus electrodes 11*b*, 13*b* is exposed to each exposure region B.

Even in this case, as shown in FIG. 3, where both of the X and Y electrodes 11, 13 are partially protruded to the non-discharge region A, the misdischarge is prevented in the non-discharge region A including exposure region B. It is because the X electrode 11 is exposed to the exposure region B of one of the discharge cells 7R, 7G, 7B and the Y electrode 13 is exposed to the next exposure region B of the neighboring discharge cell 7R, 7G or 7B in the x-direction. In other words, when a part of two bus electrodes 11*b*, 13*b* of the X and Y electrodes 11, 13 is exposed to one of the exposure regions B, no misdischarge occurs between the two bus electrodes 11*b*, 13*b* because one bus electrode 13*b* is blocked by the barrier rib 5 in spite of the other bus electrode 11*b* being exposed to the exposure region B.

The barrier ribs 5 may be formed in a variety of arrangements to fulfill the role of the non-discharge region A and the exposure region B. However, the present embodiment shows first, second and third barrier rib members 5*a*, 5*b*, 5*c*. Also, a fourth barrier rib member 5*d* is included in the embodiment illustrated in FIGS. 1 and 2.

The first barrier rib members 5*a* are formed in the extending direction (y-direction) of the address electrodes 15 and placed parallel to each other with a pitch of the discharge cells 7R, 7G, 7B in the x-direction. The separated first barrier rib members 5*a* form the independent discharge cells 7R, 7G, 7B. The second barrier rib members 5*b* are formed in the direction (x-direction) crossing the first barrier rib members 5*a* and placed parallel to each other with a pitch of the discharge cells 7R, 7G, 7B in the y-direction. The second barrier rib members 5*b* are formed separately to connect each two neighboring discharge cells in the x-direction. Therefore, the first barrier rib members 5*a* and the second barrier rib members 5*b* join at two diagonal corners of the discharge cell 7R, 7G, 7B and form a right angle. At other two diagonal corners, each end of the first barrier rib members 5*a* and the second barrier rib members 5*b* is connected to an inclined third barrier rib member 5*c*. Therefore, other two corners of the discharge cell 7R, 7G, 7B except two right-angled corners are formed with an inclination.

In other words, each of the discharge cells 7R, 7G, 7B is formed in an asymmetrical structure having two diagonal corners with a right angle and two diagonal corners with an inclination. Therefore, both sides of the discharge cell 7R, 7G, 7B in the extending direction (y-direction) of the address electrodes 15 are formed narrower than the center of the discharge cell 7R, 7G, 7B. To be specific, in both sides of the discharge cell 7R, 7G, 7B in the extending direction (y-direction) of the address electrode, one corner is formed with a right angle and the other corner is formed inclined so that the discharging region becomes narrower as it moves from the center of the discharge cell to the sides.

The discharge cells 7R, 7G, 7B are formed to substantially minimize or reduce the discharging regions that contribute little to the improvement in its sustain discharge and luminance. Both sides of the discharge cell 7R, 7G, 7B in the extending direction (y-direction) are formed narrower than the center of the discharge cell 7R, 7G, 7B as it moves away from the center. In one side of the discharge cell 7R, 7G, 7B, one corner is formed with a right angle and the other corner is formed with an inclination. This is done to prevent the misdischarge in the non-discharge region A between the bus electrodes 11*b*, 13*b* by blocking one of the bus electrodes 11*b*, 13*b* using the barrier rib 5.

In addition, the barrier rib 5 shown in FIGS. 1 and 2 includes a fourth barrier rib member 5*d*. The fourth barrier rib member 5*d* is positioned between the second barrier rib member 5*b* of one discharge cell 7R, 7G, 7B and the adjacent second barrier rib member 5*b* of the neighboring discharge cell 7R, 7G, 7B in the y-direction, and connects both. The fourth barrier rib member 5*d* gives strength to the discharge cell 7R, 7G, 7B structure formed by the barrier ribs 5.

Figure 4:
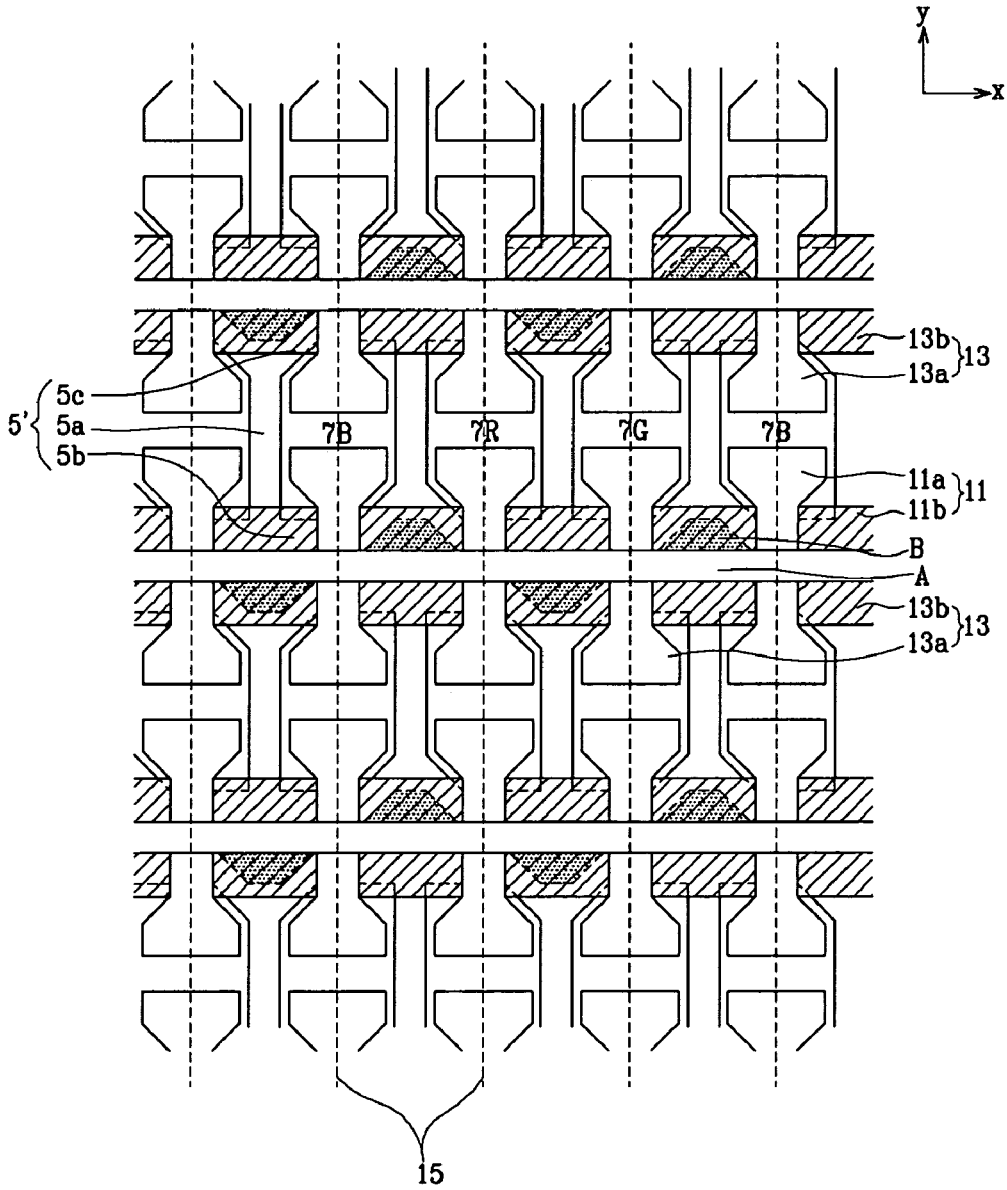
FIG. 4 is a partial plan view of a plasma display panel according to another exemplary embodiment of the present invention.
Figure 5:
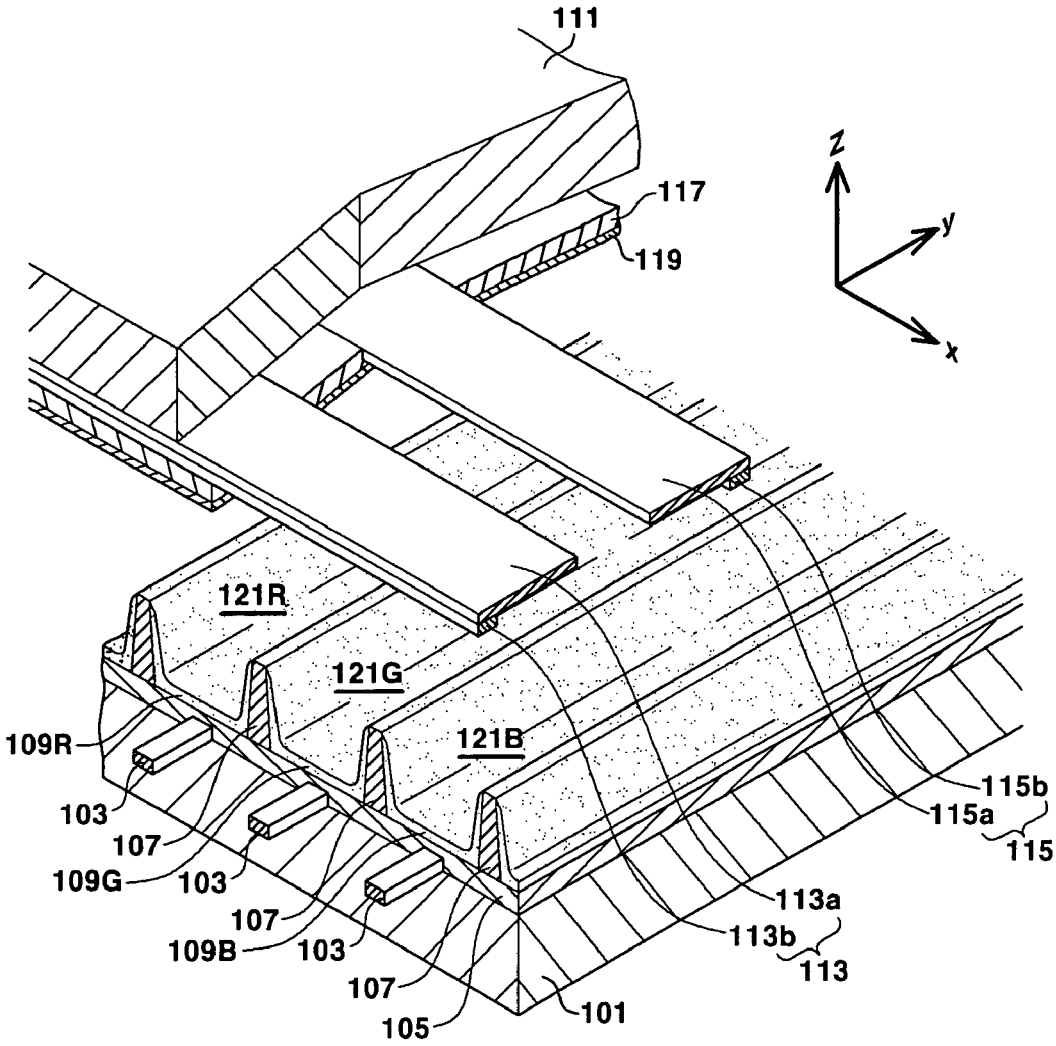
FIG.5 (Prior Art)
FIG. 5 is a partial perspective view of a disassembled plasma display panel according to prior art.

FIG. 4 is an embodiment different from that shown in FIGS. 1 to 3. As shown in FIG. 4, barrier ribs 5' include first, second and third barrier rib members 5*a*', 5*b*', 5*c*' only and do not include a fourth barrier rib member. The barrier ribs 5' form an open passage extending in the x-direction between the discharge cells 7R, 7G, 7B. The open passage serves to dissipate heat efficiently from the plasma discharge and to enhance exhaust conductance, as an exhaust passage, for exhausting the space between the newly joined front and rear substrates 1, 3.

Hereinafter, the non-discharge region A and the exposure region B are described in detail.

The exposure region B is formed at one side of the first barrier rib member 5*a* placed in the extending direction (y-direction) of the address electrodes 15. In the discharge cells 7R, 7G, 7B arranged in the x-direction, the exposure regions B are formed at one side of the first barrier rib member 5*a* and at the opposing side of the adjacent first barrier rib member 5*a* thereto. Therefore, the exposure regions B are formed at the diagonal positions of two first barrier rib members 5*a* in each discharge cell 7R, 7G, 7B and placed in a zigzag pattern in the extending direction (x-direction) of the display electrodes 11, 13. That means that the locations of the exposure regions B are alternating between the positions of the X electrode 11 in one discharge cell 7R, 7G, 7B and the Y electrode 13 in the neighboring discharge cell 7R, 7G, 7B.

In the plasma display panel of the present invention, as explained hereinabove, the exposure regions where the display electrode, i.e., a part of the bus electrode is exposed are arranged alternately in the extending direction of the display electrode. While one bus electrode is partially exposed to the exposure region, the other bus electrode of the neighboring discharge cell is blocked by the barrier rib. This effectively prevents misdischarge in the non-discharge regions between two adjacent bus electrodes.

Although exemplary embodiments of the present invention have been described in detail hereinabove, it should be understood that many variations and/or modifications of the basic inventive concept taught therein will still fall within the spirit and scope of the present invention, as defined in the appended claims and equivalents thereof.

What is claimed is:

1. A plasma display panel comprising:

a first substrate;

a second substrate facing the first substrate;

a plurality of display electrodes extending on the first substrate in a first direction;

a plurality of address electrodes extending on the second substrate in a second direction and crossing the display electrodes;

barrier ribs comprising a plurality of barrier rib members, the barrier ribs being positioned between the first substrate and the second substrate and forming a plurality of discharge cells and non-discharge regions surrounded by the barrier ribs; and a phosphor formed inside each of the discharge cells, wherein portions of the display electrodes overlap exposure regions of the non-discharge regions, and wherein the portions of one of the display electrodes overlapping the exposure regions are located at every other one of the non-discharge regions in the first direction.

2. The plasma display panel of claim 1, wherein each of the exposure regions is formed at one side of one of the barrier rib members extending in the first direction.

3. The plasma display panel of claim 1, wherein the exposure regions are formed alternately at one side of one of the barrier rib members extending in the first direction and at an opposing side of an adjacent one of the barrier rib members extending in the first direction.

4. The plasma display panel of claim 1, wherein the exposure regions are formed adjacent to the barrier rib members that are at two diagonal positions of each of the discharge cells.

5. The plasma display panel of claim 1, wherein the exposure regions are formed at alternating locations in a zigzag pattern in the first direction.

6. The plasma display panel of claim 1, wherein the display electrodes comprise an X electrode corresponding to a first discharge cell of the discharge cells and a Y electrode corresponding to a second discharge cell of the discharge cells, the second discharge cell being adjacent to the first discharge cell, and wherein the exposure regions are formed alternately between the X electrode and the Y electrode.

7. The plasma display panel of claim 1, wherein each of the display electrodes consists of a bus electrode and a transparent electrode, and wherein a part of the bus electrode of each of the display electrodes is exposed to at least one of the exposure regions.

8. The plasma display panel of claim 7, wherein the bus electrode of each of the display electrodes extends in the first direction, and wherein a part of the bus electrode corresponding to one of the discharge cells overlaps a corresponding one of the exposure regions and another bus electrode corresponding to an adjacent one of the discharge cells overlaps one of the barrier rib members extending in the first direction.

9. The plasma display panel of claim 1, wherein the barrier rib members comprise:

first barrier rib members extending in the second direction and placed parallel to each other;

second barrier rib members crossing the first barrier rib members and placed parallel to each other; and third barrier rib members connecting the first and second barrier rib members at an incline at two diagonal corners of each of the discharge cells.

10. The plasma display panel of claim 9, wherein the second barrier ribs are interconnected by fourth barrier rib members, each of which is positioned between the second barrier rib member of one of the discharge cells and the adjacent second barrier rib member of an adjacent one of the discharge cells.

11. The plasma display panel of claim 1, wherein each of the discharge cells is formed to be asymmetrical about one of the first direction or the second direction.

12. The plasma display panel of claim 1, wherein both ends of each of the discharge cells in the second direction are narrower than a center of each of the discharge cells.

13. The plasma display panel of claim 1, wherein at each of two ends of each of the discharge cells with respect to the second direction, one corner is formed with a right angle and the other corner is formed with an incline such that a discharging region of the discharge cell becomes narrower in the second direction from a center of the discharge cell to the corresponding end of the discharge cell.

14. A plasma display panel comprising:

a first substrate;

a second substrate facing the first substrate;

a plurality of display electrodes extending in a first direction on the first substrate;

a plurality of address electrodes on the second substrate, and extending in a second direction substantially perpendicular to the first direction;

barrier ribs positioned between the first and second substrates, and forming a plurality of discharge cells and non-discharge regions surrounded by the barrier ribs; and a phosphor formed inside each of the discharge cells, wherein each of the display electrodes partially overlaps every other one of the non-discharge regions in the first direction.

15. The plasma display panel of claim 14, wherein each of the non-discharge regions includes an exposure region overlapping a portion of a corresponding one of the display electrodes, and wherein the exposure regions of the non-discharge regions located in the first direction alternately overlap the portion of a first said corresponding one of the display electrodes and the portion of a second said corresponding one of the display electrodes.

16. The plasma display panel of claim 14, wherein the barrier ribs include at least two barrier rib members coupling adjacent ones of the discharge cells in the second direction.

17. The plasma display panel of claim 14, wherein the barrier ribs define a passage extending in the first direction between two adjacent rows of the discharge cells in the first direction.

18. The plasma display panel of claim 14, wherein each of the barrier ribs forming one of the discharge cells comprises:

a pair of first barrier rib members extending in the second direction, and placed parallel to each other;

a pair of second barrier rib members extending in the first direction and placed parallel to each other; and third barrier rib members connecting the first and second barrier rib members at an incline at two diagonal corners of the one of the discharge cells.

19. The plasma display panel of claim 14, wherein the display electrodes comprise sustain electrodes and scan electrodes, wherein adjacent ones of the sustain and scan electrodes overlap different ones of the non-discharge regions.

20. The plasma display panel of claim 14, wherein each of the display electrodes comprises a bus electrode and a plurality of transparent electrodes protruding therefrom, and wherein the bus electrode partially overlaps the every other one of the non-discharge regions.

* * * * *